US005577600A

United States Patent [19]

Schoene et al.

[11] Patent Number: 5,577,600

[45] Date of Patent: Nov. 26, 1996

[54] SWITCH LOCK-OUT DEVICE FOR POWER TOOL

[75] Inventors: Keith R. Schoene, St. Charles; Daniel A. Terpstra, Kirkwood, both of Mo.

[73] Assignee: Emerson Electric Co., St. Louis, Mo.

[21] Appl. No.: 561,380

[22] Filed: Nov. 21, 1995

[51] Int. Cl.[6] ..... H01H 9/28

[52] U.S. Cl. ..... 200/43.17; 200/43.16; 200/321; 200/322

[58] Field of Search ..... 200/43.17, 43.15, 200/321, 322, 327, 310

[56] References Cited

U.S. PATENT DOCUMENTS

| | | | |
|---|---|---|---|
| 3,746,813 | 7/1973 | Brown | 200/157 |
| 3,769,473 | 10/1973 | Lay | 200/61.58 |
| 3,847,233 | 11/1974 | Glover et al. | 200/43.17 |
| 3,873,796 | 3/1975 | Worobec, Jr. | 200/157 |
| 3,881,081 | 4/1975 | Schilling et al. | 200/157 |
| 3,950,625 | 4/1976 | Klebe, Jr. et al. | 200/61.58 |
| 3,971,906 | 7/1976 | Sahrbacker | 200/157 |
| 4,006,334 | 2/1977 | Robotham et al. | 200/157 |
| 4,018,292 | 4/1977 | Roll et al. | 173/170 |
| 4,066,856 | 1/1978 | Merkle | 200/44 |
| 4,097,703 | 6/1978 | Houser | 200/157 |
| 4,219,714 | 8/1980 | Suzuki et al. | 200/157 |
| 4,376,240 | 3/1983 | Stuart | 200/322 |
| 4,504,707 | 3/1985 | Ochiai | 200/42 |
| 4,695,684 | 9/1987 | Bochard et al. | 200/43.07 |
| 4,879,438 | 11/1989 | Winchester | 200/61.85 |
| 5,161,679 | 11/1992 | Russo | 200/43.17 |

*Primary Examiner*—David J. Walczak

*Attorney, Agent, or Firm*—Polster, Lieder, Woodruff & Lucchesi

[57] ABSTRACT

A switch lock-out device to prevent unintended operation of a power tool through inadvertent actuation of a trigger operably associated with a motor as disclosed. The trigger is pivotally mounted in handle grip for energizing the power tool when depressed. An outer free end of the trigger extends within the handle grip. The switch lock-out device includes an integral multiple-armed element that is pivotally mounted within the handle grip. The pivotally mounted multiple-armed element includes a first arm that engages the outer free end of the trigger to prevent actuation, a second arm that includes a manual engageable button that extends outside of the handle grip and a third arm that engages an internal wall of the handle grip in biased and resilient engagement. When the manually engageable button is depressed, a first arm of the multiple-armed element is pivoted out of engagement with the free end of the trigger for actuation of the trigger to operate the power tool. Subsequent release of the manually engageable button enables the third arm biased against an internal wall of a handle grip to return the second arm and its manually engageable button to its normal position for subsequent re-engagement with the free end of the trigger when released.

7 Claims, 3 Drawing Sheets

SWITCH LOCK-OUT DEVICE FOR POWER TOOL

BACKGROUND OF THE INVENTION

The present invention relates to a switch lock-out device to prevent unintended operation of a power tool through inadvertent actuation of a trigger operably associated with a motor that operates the power tool.

Portable power tools (hedge trimmers, grass shearers and the like) as well as non-portable power tools (compound miter saws, radial arm saws and the like) include trigger mechanisms that have incorporated a lock-off feature, and in the case of some portable power tools, a lock-on feature, as well. The prior art contains many different types and kinds of lock-out devices, the construction and operation of which are shown in detail in the references supplied to the U.S. Patent and Trademark Office by applicants.

The present invention is directed to a switch lock-out device for power tools in which a trigger is mounted in a power tool hand grip and operates a switch actuator that is contained within the handle grip. In order to provide a switch lock-out feature for the trigger in this environment, the switch lock-out device must work in conjunction with the trigger that projects, in part, outside of the handle grip, as well as the switch actuator that is not accessible within the handle grip. At the same time, the switch lock-out device must prevent inadvertent actuation of the trigger which could result in unintended operation of the power tool.

SUMMARY OF THE INVENTION

Among the several objects and advantages of the present invention include:

the provision of a new and improved switch lock-out device to prevent unintended operation of a power tool through inadvertent actuation of a trigger that is operably associated with a motor;

the provision of the aforementioned switch lock-out device which includes an integral multiple-armed element having a first arm that prevents actuation of the trigger until manual engagement of a second arm which pivots the first arm out of the way for actuation of the trigger, while causing a third arm serving as in integral biasing element to permit the first and second arms to be moved between the aforementioned locked and unlocked positions;

the provision of the aforementioned switch lock-out device in which the multiple-armed element is an integral one-piece element that is formed from durable yet resilient plastic material having both rigid and resilient arms; and the provision of the aforementioned switch lock-out device which is simple in construction, durable, essentially maintenance-free, easy to manufacture and operate, and is otherwise well adapted for the purposes intended.

Briefly stated, the present invention provides a switch lock-out device to prevent unintended operation of a power tool through inadvertent actuation of a trigger operably associated with a motor that operates the power tool. A handle grip for the power tool includes a pivotally mounted trigger which energizes the motor for operation of the power tool when depressed. The trigger includes an outer free end which extends within the handle grip. The switch lock-out device includes an integral multiple-armed element that is pivotally mounted within the handle grip. Each arm of the multiple-armed element extends from its pivotal mount and includes a first arm for engaging the outer free end of the trigger to prevent actuation thereof. A second arm includes a manually engageable button at its outer end, the manually engageable button extending outside of the handle grip. A third arm engages an internal wall of the handle grip in biased and resilient engagement. Thus, upon manual depression of the manually engageable button, the first arm is pivoted out of engagement with the free end of the trigger for actuation of the trigger to operate the power tool. Release of the manually engageable button enables the third arm biased against an internal wall of the handle grip to return the second arm and its associated manually engageable button to its normal position for subsequent re-engagement of the first arm with the free end of the trigger when released.

The first arm of the integral multiple-armed element extends downwardly from its pivot mount for engagement with the outer free end of the trigger. The second arm of the integral multiple-armed element extends generally transverse to the first arm. The third arm of the integral multiple-armed element also extends generally transverse to the first arm and in a generally opposite direction from the second arm.

The manually engageable button extends generally transverse to the second arm at its outer free end for extension outside of the handle grip. An outer free end of the third arm facilitates biased engagement with a protuberance on the internal wall of the handle grip.

These and other objects and advantages of the presents invention will become apparent from the description that follows:

Figure 1:
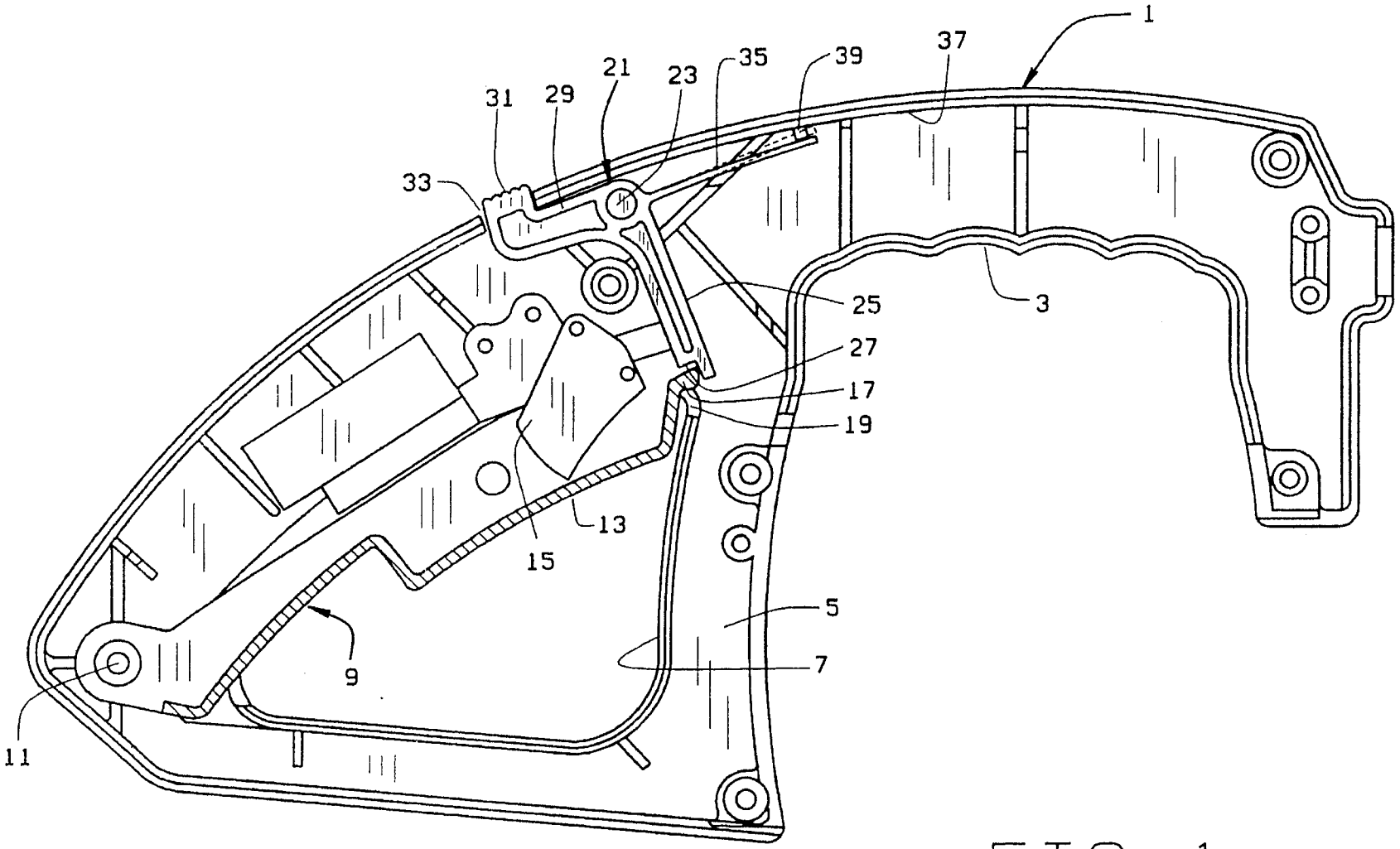
FIG. 1 is a side elevational view, partly in section, of a handle grip used in a compound miter saw or the like with an outer face thereof removed to expose the working components of the switch lock-out device of the present invention which is illustrated in its locked position to prevent inadvertent actuation of a trigger associated with the handle grip.

Corresponding referenced numerals will be used throughout the various figures of the drawing.

DESCRIPTION OF THE PREFERRED EMBODIMENTS

The following detailed description illustrates the invention by way of example and not by way of limitation. This description will clearly enable one skilled in the art to make and use the invention, and describes several embodiments, adaptations, variations, alternatives and uses of the invention, including what we presently believe is the best mode of carrying out the invention.

Figure 2:
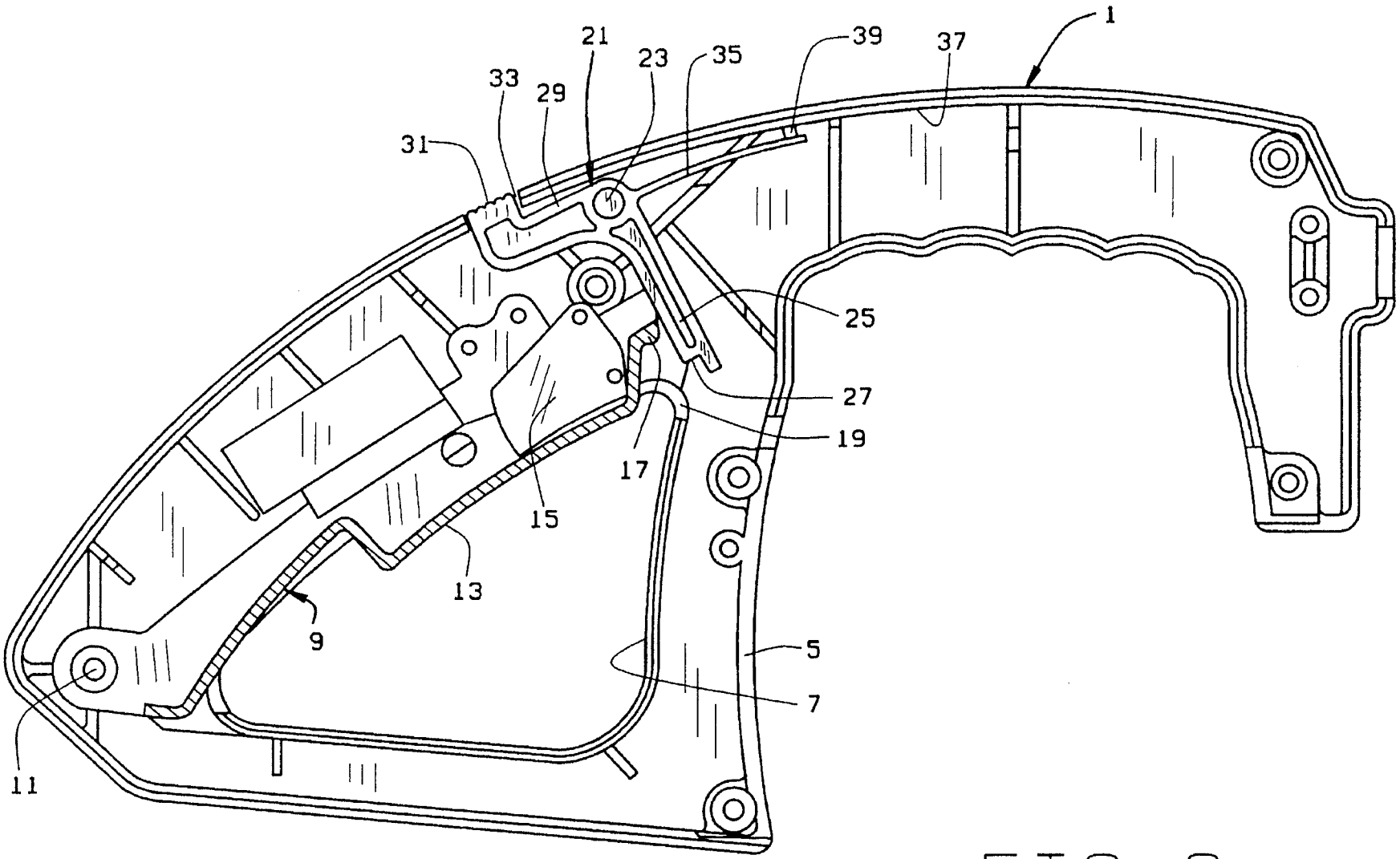
FIG. 2 is a side elevational view, partly in section, of the handle grip similar to FIG. 1, but showing the switch lock-out device in its non-locked position for actuation of the trigger associated with the handle grip.
Figure 5:
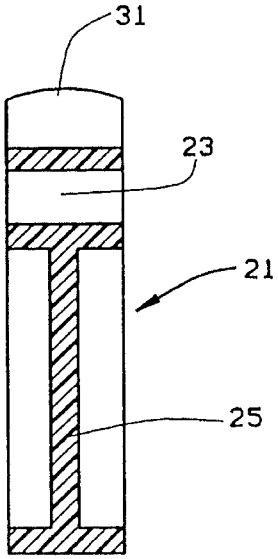
FIG. 5 is a sectional view of the multiple-armed element or switch lock-out device shown in FIG. 3, as being along the lines 5—5 of FIG. 3.
Figure 4:
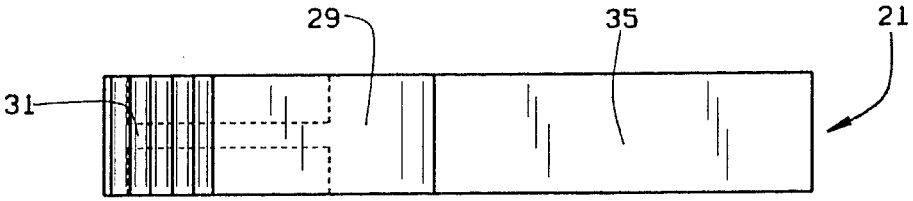
FIG. 4 is a top plan view of the multiple-armed element or switch lock-out device shown in FIG. 3.
Figure 3:
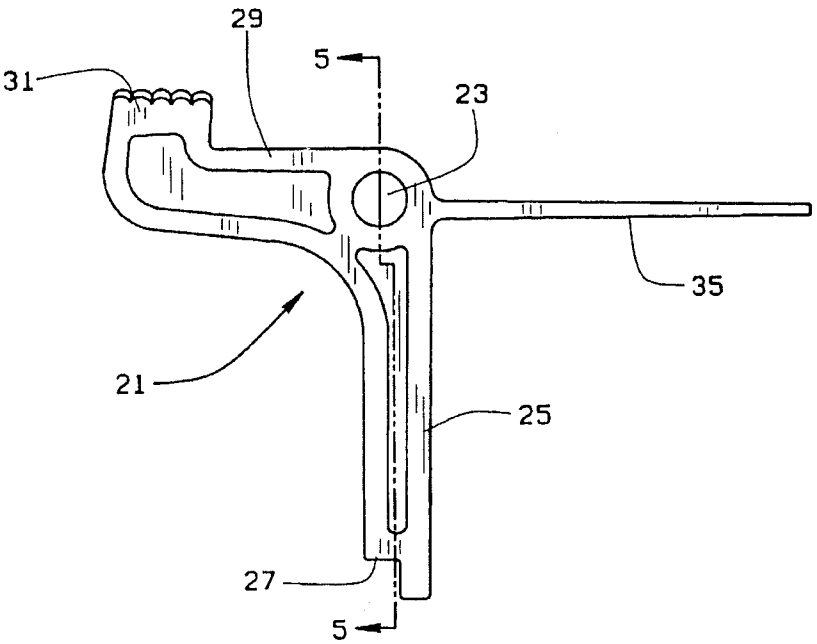
FIG. 3 is an enlarged side elevational view of the integral multiple-armed element which functions as the switch lock-out device of the present invention.

FIGS. 1–2 of the drawings show the switch lock-out device of the present invention in its locked (FIG. 1) position and unlocked (FIG. 2) position. The handle grip 1 is of conventional construction as a durable injection molded generally hollow element having operating components within the hollow portion of the handle grip 1. Specifically, the handle grip 1 includes a generally horizontally extending finger gripping portion 3 for gripping by several fingers of a user's hand, and a triangularly shaped section 5 forming a triangularly shaped opening 7 in which a trigger 9 is positioned. The trigger 9 is pivotally mounted at 11 to the handle grip 1 and includes a finger engaging area 13, the inside wall of which engages a switch actuator 15 that is coupled to a motor (now shown) for operating a power tool (also not shown). The outer free end of 17 of the trigger 9 extends within the handle grip 1 and is arranged to engage the switch lock-out device of the present invention. The outer free end 17 of the trigger 9 is arranged to move within an opening 19 formed in the perimeter of the triangularly-shaped handle grip 5, in the area of the outer free end 17 of the trigger 9.

The switch lock-out device 21 of the present invention is specifically configured, arranged and dimensioned to prevent unintended operation of a power tool, such as a compound miter saw, through the inadvertent actuation of the trigger 9 that is operably associated through the switch actuator 15 with a motor (not shown) that operates the power tool (also not shown). The switch lock-out device is illustrated in FIG. 1 of the drawings in locked position relative to the outer free end 17 of the trigger 9 and in FIG. 2 in its non-locked position relative to the outer free end 17 of the trigger 9. In its locked position, the trigger is prevented from inadvertent actuation, until the switch lock-out device 21 is moved to its non-locked position, enabling the trigger 9 to then operate.

In order to perform its multi-functions, the switch lock-out device 21 is constructed as an integral multiple-armed element that is pivotally mounted at 23 within the handle grip 1. The switch lock-out device 21 is preferably injection molded from a durable yet resilient plastic material, enabling portions of the switch lock-out device to provide rigid and resilient functions for the multiple-armed element or switch lock-out device 21 of the present invention.

Specifically, the integral multiple-armed element 21 includes a first arm 25 that extends downwardly at an angle from the pivotal mount 23. The first arm 25 is elongated with a central thin-webbed construction for economy of material and design. The lower end of the first arm 25 includes a recessed area 27 which engages the outer free end 17 of the trigger 9 to lock same against inadvertent actuation, as illustrated in FIG. 1. Thus, when the first arm 25 with its recessed area 27 engages the outer free end 17 of the trigger 9, the trigger 9 cannot be depressed, since the relatively rigid first arm 25 prevents movement of the trigger 9, as illustrated in FIG. 1.

The multiple-armed element also includes a second arm 29, also having an elongated shape with a central thin-webbed construction, which extends from the pivot mount 23 in a generally transverse direction to the first arm 25. At the outer free end of the second arm 29 is a manually engageable button 31 which extends generally transverse to the second arm 29 and extends through an opening 33 in the handle grip 1. It will be noted that the outer upper surface of the manually engageable button 31 is knurled or textured to facilitate engagement. The manually engageable button 31 is also located on the midline, rather than one one side, of the handle grip 1 in order to facilitate easier ambidextrous operation.

The multiple-armed element 21 further includes a third arm 35 which extends from the pivot mount 23 and extends also in a generally transverse direction to the first arm 25 which is generally in the opposite direction from the second arm 29. The third arm 35 is also elongated with a small or thin width to facilitate resilient or biased engagement with an inner wall 37 of the handle grip 1. The outer free end of the elongated flexible arm 35 engages a protuberance 39 on the internal wall 37 of the handle grip 1 to facilitate biased or resilient engagement.

The operation of the multiple-armed element or switch lock-out device 21, in connection with the trigger 9, will now be explained.

When the manually engageable button 31 of the second arm 29 is depressed from the position shown in FIG. 1 to that illustrated in FIG. 2, it will be seen that the first arm 25 is pivoted about the pivot mount 23 from the position shown in FIG. 1 to the position shown in FIG. 2. In its FIG. 1 or locked position, the first arm 25 engages the outer free end 17 of the trigger 9, in the recessed area 27 thereof, in order to prevent movement of the trigger 9 about its pivot. As will be apparent, the outer free end 17 is held against movement by the rigid first arm 25. However, when the manually engageable button 31 of the second arm 29 is depressed, the first arm 25 is moved from its FIG. 1 to its FIG. 2 position, as the result of the pivotal movement of the first arm 25 about the pivotal mount 23. When this occurs, the outer free end 17 of the trigger 9 is no longer received within the recessed area 27 of the first arm 25, enabling the trigger 9 to be depressed for engaging the switch actuator 15 that is connected to the motor (not shown) for operating the power tool (also not shown). Pivotal movement of the first arm 25 from the position shown in FIG. 1 to the position shown in FIG. 2 also results in greater resilient or biased engagement of the third arm 35 against the protuberance 39 of the inner wall 37. Thus, when the manually engageable button 31 of the second arm 29 is released, the resilient and biased third arm 35 causes the first arm 25 to return to its position illustrated in FIG. 1 where the recessed area 27 can engage the outer free end 17 of the trigger 9, upon release of the trigger 9 and movement of same to its FIG. 1 position. The resilient and biasing effect of the third arm 35 against the inner wall 37 of the handle grip 1 also causes the manually engageable button 31 of the second arm 29 to be moved from the position shown in FIG. 2 to its exposed position illustrated in FIG. 1 for subsequent re-engagement. In this way, the integral multiple-armed element 21 is constructed, arranged and dimensioned to provide both rigid and resilient cooperating features that prevent inadvertent actuation of the trigger 9.

From the foregoing, it will now be appreciated that the present invention discloses a novel and unique switch lock-out device to prevent unintended operation of a power tool through inadvertent actuation of a trigger operatively associated with a motor that itself operates the power tool. The switch lock-out device, in the form of an integral multiple-armed element, prevents actuation of the trigger, until the multiple-armed element is moved from a locked to an unlocked position, enabling the trigger to be used for normal operation of the power tool. In its locked position; however, the multiple-armed element prevents the trigger from inadvertent actuation so as to prevent undesired and unintended operation of the power tool.

In view of the above, it will be seen that the several objects and features of this invention are achieved and other advantageous results obtained.

As various changes could be made in the above construction without departing from the scope of the invention, it is intended that all matter contained in the above description or shown in the accompanying drawings shall be interpreted as illustrative and not in a limiting sense.

We claim:

1. A switch lock-out device to prevent unintended operation of a power tool through inadvertent actuation of a trigger operatively associated with a motor that operates the power tool comprising:

a handle grip including a pivotally mounted trigger which is adapted to energize a power tool when depressed, said trigger including an outer free end which extends within the handle grip; and a switch lock-out device to prevent inadvertent actuation of the trigger and including an integral multiple-armed element pivotally mounted to a pivotal mount within the handle grip, each arm of the multiple-armed element extending from said pivotal mount within the handle grip and including:

a first arm for engaging the outer free end of the trigger to prevent actuation thereof;

a second arm extending in generally parallel relationship to and along an upper wall of the handle grip, said second arm including a generally transversely extending manually depressible button at an outer free end which extends through an opening in the upper wall so as to extend outside of the handle grip; and a third arm engaging the upper wall of the handle grip in biased and resilient engagement for causing upward resilient biasing of the button of the second arm and engagement of the first arm with the trigger until the button is depressed;

whereby manual depression of the button pivots the first arm out of engagement with the free end of the trigger for actuation of the trigger to operate the power tool and release of the button enables the third arm that is biased against the upper wall of the handle grip to return the second arm and its associated button to its upward resiliently biased position for subsequent re-engagement of the first arm with the outer free end of the trigger.

2. The switch lock-out device as defined in claim 1 wherein the first arm of the integral multiple-armed element extends generally downwardly from said pivot mount for engagement with the outer free end of the trigger.

3. The switch lock-out device as defined in claim 2 wherein the second arm of the integral multiple-armed element extends generally transverse to the first arm.

4. The switch lock-out device as defined in claim 3 wherein the third arm of the integral multiple armed element also extends generally transverse to the first arm and in a generally opposite direction from the second arm.

5. The switch lock-out device as defined in claim 4 wherein an outer free end of the third arm is in biased engagement with a protuberance on the upper wall of the handle grip.

6. The switch lock-out device as defined in claim 3 wherein the manually depressible button extends generally transverse to the second arm at the outer free end thereof.

7. A switch lock-out device to prevent unintended operation of a power tool through inadvertent actuation of a trigger operably associated with a motor that operates the power tool, comprising:

a handle grip including a pivotally mounted trigger which is adapted to energize a power tool when depressed, said trigger including an outer free end which extends within the handle grip; and a switch lock-out device to prevent inadvertent actuation of the trigger and including an integral multiple-armed element pivotally mounted to a pivotal mount within the handle grip, each arm of the multiple-armed element extending from said pivotal mount and including:

a first arm extending downwardly from said pivotal mount for engaging the outer free end of the trigger to prevent actuation thereof;

a second arm extending from the pivotal mount along an upper wall of the handle grip in generally transverse direction to the first arm and including a manually depressible button at its outer free end, said manually depressible button extending generally transverse to the second arm and being received within an opening in the upper wall of the handle grip so as to extend outside of the handle grip; and a third resilient arm extending from the pivotal mount in a generally opposite direction from said second arm, said third arm extending along and engaging the upper wall of the handle grip in biased and resilient engagement to cause the first arm to be moved about the pivotal mount and into engagement with the outer free end of the trigger to prevent inadvertent actuation of the trigger while the button of the second arm is resiliently biased upwardly until depressed; and said first arm being pivotally moved out of engagement with the outer free end of the trigger when the button is depressed for actuation of the trigger to operate the power tool.

* * * * *